US005427039A

United States Patent [19]

Bagnell

[11] Patent Number: 5,427,039

[45] Date of Patent: Jun. 27, 1995

[54] SLIDING NEEDLE BAR DRIVE FOR TUFTING MACHINES

[75] Inventor: Arthur F. Bagnell, Whitefield, England

[73] Assignee: Spencer Wrigth Industries, Inc., Dalton, Ga.

[21] Appl. No.: 186,428

[22] Filed: Jan. 25, 1994

[30] Foreign Application Priority Data

Feb. 10, 1993 [GB] United Kingdom ..... 9302556

[51] Int. Cl.[6] ..... D05C 15/30

[52] U.S. Cl. ..... 112/80.41; 112/284

[58] Field of Search ..... 248/281.1, 292.1, 585, 248/586, 587; 74/105, 110; 414/917; 112/80.41, 284, 220, 221, 80.01

[56] References Cited

U.S. PATENT DOCUMENTS 3,973,748 8/1976 Nagasaka ..... 248/586
4,399,758 8/1983 Bagnall ..... 112/80.41
4,465,001 8/1984 Ingram ..... 112/80.41
5,205,229 4/1993 Job ..... 112/80.41

*Primary Examiner*—Andrew M. Falik
*Assistant Examiner*—Paul C. Lewis
*Attorney, Agent, or Firm*—Alan Ruderman

[57] ABSTRACT

A drive mechanism for connecting the output drive of a tufting machine pattern control to the needle bar of the tufting machine includes a linkage having a pair of links each connected at one end to a plate fastened to the output drive rod of the pattern control and having second ends which are connected to a lever at spaced apart locations. One end of the lever is connected to the needle bar of the tufting machine. One of the links is substantially longer than the other link and the locations of the connection to the lever is such that the attachment of the lever to the needle bar produces substantially vertical straight line motion at that point as the needle bar reciprocates. Thus, the needle bar may be shifted laterally by the mechanism as determined by the pattern control, and yet reciprocates in a straight line path.

6 Claims, 2 Drawing Sheets

SLIDING NEEDLE BAR DRIVE FOR TUFTING MACHINES

BACKGROUND OF THE INVENTION

This invention relates to tufting machines and more particularly to apparatus for connecting a needle bar of a tufting machine to a pattern control which permits the needle bar to move laterally as driven by the pattern control while permitting the needle bar to reciprocate in a path normal to the lateral movement.

In the art of tufting one or more rows of yarn carrying needles are reciprocably driven through a base material fed through the tufting machine to form loops that are seized by loopers or hooks oscillating below the base material in timed relationship with the needles.

The needles are typically carried by a needle bar supported at the end of a plurality of push rods constrained for reciprocatory motion toward and away from the loopers or hooks. In those machines having a sliding needle bar arrangement, i.e., wherein the needle bar is controllably driven by pattern means transverse to the direction of movement of the backing material so as to break up the alignment of longitudinal rows of tufts, reduce the affects of yarn streaking and provide patterning effects, a needle bar carrier supports the needle bar, the carrier being secured to the push rod and moving therewith to permit reciprocation of the needle bar, yet permitting the needle bar to slide relatively to the push rod. The transverse or lateral drive for the needle bar generally is supplied by a pattern controlled shifter attachment which supplies the jogging or sliding motion to the needle bar. In the prior art, the apparatus for jogging the needle bar in accordance with the motions provided by the pattern controlled shifter includes a pair of rollers which straddle a plate or block carried by the needle bar and are attached to a drive rod connected to the shifter. As the needle bar reciprocates, the rollers roll up and then down in contact with the plate or block, and yet the block is moved laterally in accordance with the pattern control shifter.

This connection between the shifter drive rod and the needle requires that the rollers reverse rotational direction each time the needle bar reverses direction during its reciprocating cycle. For example, as the needle bar moves downwardly, the rollers first rotate in one direction, and as the needle bar reaches bottom dead center and reverses direction, the rotational direction of the rollers must change. The rollers are hardened cam followers and the plate or block must also be hardened steel to prevent excessive wear. Normally one of the rollers is adjustable relative to the other roller, and as wear occurs the adjustable roller is adjusted to remove play which evolves. In high speed tufting machines, the needle bar reciprocates rapidly and the rotational directions of the rollers reverse quickly. The frictional forces resulting from such rapid reversals of direction therefor increase dramatically with higher speed tufting machines.

SUMMARY OF THE INVENTION

Consequently it is a primary object of the present invention to provide a drive mechanism for connecting a tufting machine pattern control to the needle bar of the tufting machine, the drive mechanism permitting lateral movement of the needle bar as determined by the pattern control while permitting reciprocating movement of the needle bar.

It is another object of the present invention to provide a drive mechanism for a tufting machine which interfaces with the output drive of a pattern control and with the tufting machine needle bar, the drive mechanism having low mass and relatively low bearing loads while permitting lateral movement of the needle bar as determined by the pattern control and permitting reciprocating movement of the needle bar.

It is a further object of the present invention to provide a drive connecting mechanism between a needle bar of a tufting machine and a pattern control, the drive mechanism including linkage for transferring motion from the pattern control to the needle bar in a substantially horizontal direction while simultaneously permitting the needle bar to be driven in a vertical direction.

Accordingly, the present invention provides a drive mechanism which connects or couples the output drive of a tufting machine pattern control to the needle bar of a tufting machine, the drive comprising linkage including a pair of links connected to the output drive rod of the pattern control and to a lever which is connected to the needle bar. One of the links is substantially longer than the other link and the locations of the connection to the lever is such that the attachment of the lever to the needle bar produces substantially vertical straight line motion at that point as the needle bar reciprocates. The connection of the links to the lever and to the pattern control drive rod effectively forms a quadric or four bar linkage and the lever is connected at an end remote from the links to the needle bar. Thus, as the pattern control drive rod moves laterally in a horizontal direction the needle bar is driven therewith, and the needle bar may reciprocate relative to the drive rod in the vertical direction.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
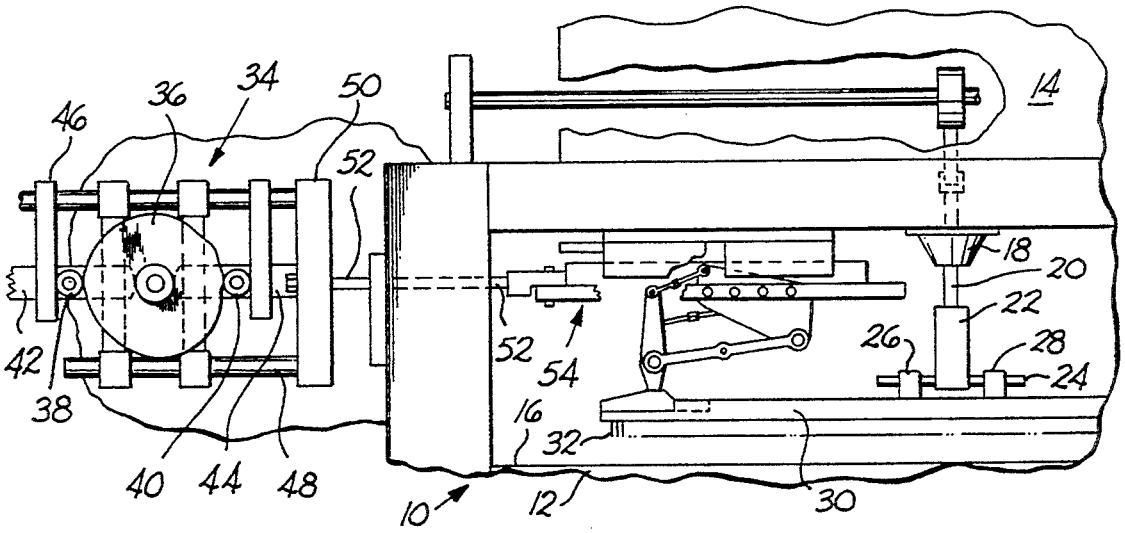
FIG. 1 is a fragmentary front elevational view with portions broken away of a tufting machine incorporating a drive mechanism constructed in accordance with the principles of the present invention for connecting a pattern control to the needle bar of a tufting machine.
Figure 3:
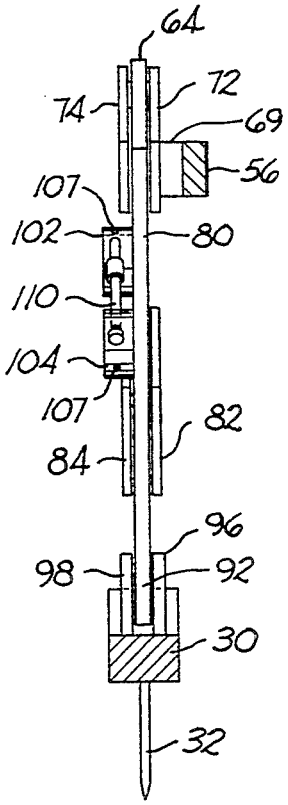
FIG. 3 is a cross sectional view taken substantially along line 3—3 of FIG. 1.
Figure 2:
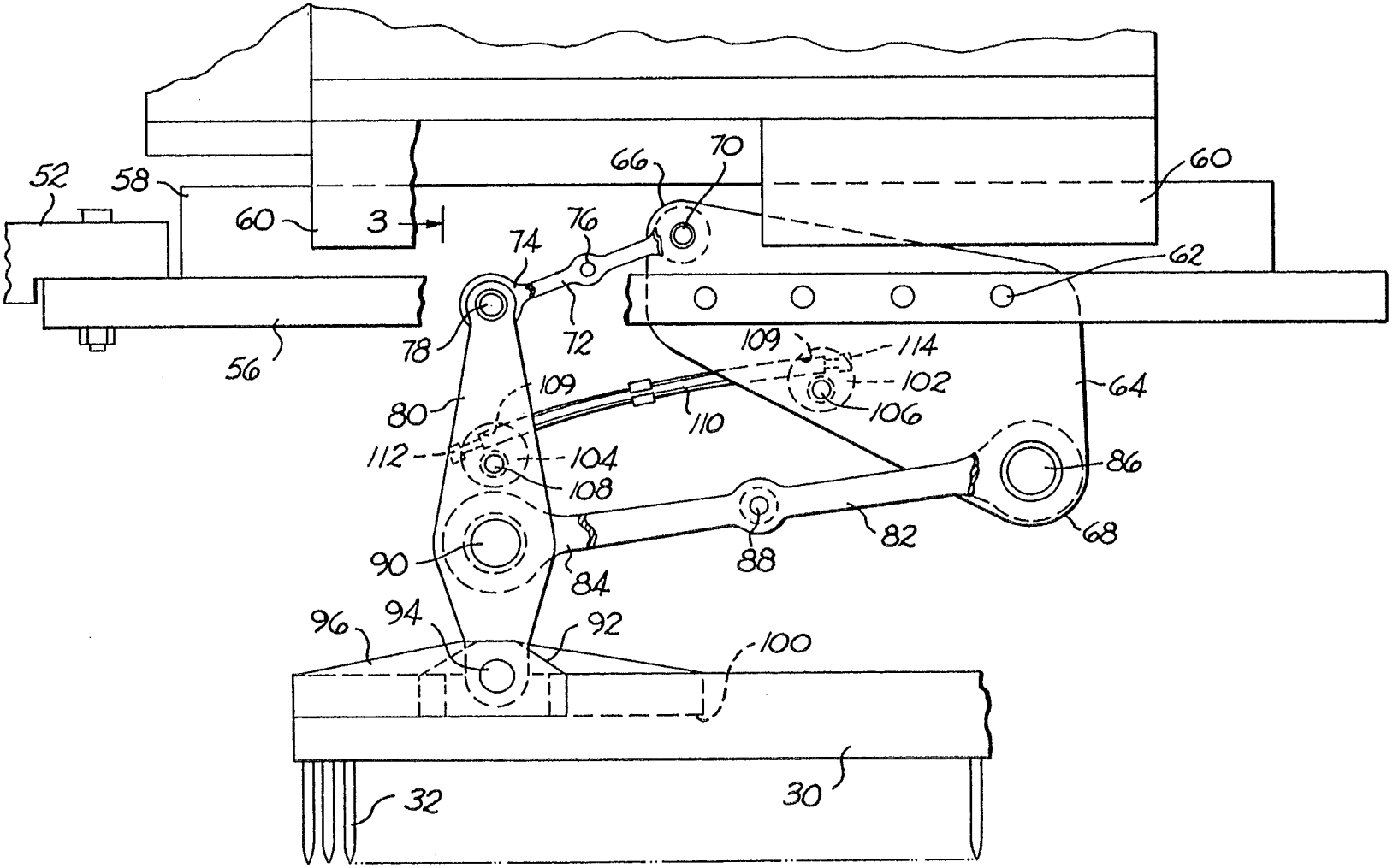
FIG. 2 is an enlarged elevational view of the drive connecting mechanism of the present invention.

Referring now to the drawings, FIG. 1 illustrates a portion of a tufting machine 10 having a frame comprising a base 12 and a head 14 disposed above the base. The base 12 includes a needle plate 16 over which a backing material (not illustrated) is adapted to be fed by conventional means.

Mounted in the head 14 for vertical reciprocation within a respective bushing assembly 18 is one of a plurality of push rods 20 to the lower end of which a needle bar support foot 22 is secured, the push rods being driven by conventional means.

Securely carried in each support foot 22 lying in a plane substantially normal to the axis of each push rod 20 is a pair of spaced apart rods 24, only one of which is illustrated, the rods being fixedly secured in each support foot and therefore reciprocably movable together with the respective push rod 20. Each rod is journally mounted in a respective linear bearing carried in a pair of blocks 26, 28, spaced apart at each lateral side of the support foot 22. The blocks 26 and 28 are secured to the needle bar 30 of the tufting machine by conventional means such as bolts, and a multiplicity of needles 32 are carried by the needle bar and are adapted to penetrate the backing material upon reciprocation of the needle bar to project loops of yarn through the backing material as the push rods are reciprocated. The needles cooperate conventionally with hooks or loopers (not illustrated) mounted in the bed 12 for seizing loops of yarn presented by the needles as is notoriously well known in the art. Moreover, lateral shifting of the needle bar 30 results in the blocks 26, 28 moving along and relative to the guide rods 24. A needle bar support construction of this type is disclosed fully in Bardsley U.S. Pat. No. 4,662,291 assigned to the common assignee with the present invention.

Although numerous pattern controls for shifting the needle bar laterally are known in the prior art, for purposes of the present invention, a shifter drive assembly 34 including a pattern cam 36 is disclosed for this purpose. The assembly 34 is supported adjacent an end of the tufting machine and includes cam followers 38, 40 carried on brackets 42, 44, the followers abutting the surface of the cam 36 at diametrically opposed locations. The brackets 42, 44 are drivingly connected to slide rods 46, 48 fastened to another bracket 50 connected to a drive rod 52. Pattern control assemblies of this type are described in Ingram U.S. Pat. No. 4,465,001 and Slattery U.S. Pat. No. 4,501,212 assigned to the common assignee with the present invention. As disclosed in these patents, the drive rod is generally secured to a block which is straddled by a pair of rollers carried by a bracket secured to the needle bar so that the needle bar may reciprocate relative to the drive rod yet move laterally with the drive rod as the drive rod is moved in response to the cam and followers. In accordance with the present invention, however, the drive rod 52 is coupled to the needle bar by a mechanism 54 forming the subject matter of the present invention as hereinafter described.

The drive rod 52, or preferably a drive rod extension 56 of the drive rod, may include or be connected to a foot 58 which is guided laterally within a slideway formed by one or more shoes 60 carried by the head 14 of the tufting machine above the needle bar 30 so that the foot 58 and thus the rod 56 may slide laterally in accordance with the pattern on the surface of the cam 36. Secured to a planar face of the rod 56, by conventional means such as bolts 62 or the like, is a drive plate 64 in the form of a substantially flat sheet of metal. The plate 64 may be of any convenient configuration having spaced apart portions 66, 68 for reasons which will hereinafter become clear, and preferably having an elongated section therebetween for providing a large surface bearing against the rod 56, or preferably a spacer 69 which bears against the rod 56.

Pivotably journalled on a pin 70 at the portion 66 of the drive plate 64 is a first end of a pair of links 72, 74 joined together substantially at the central points 76 by a spacer so that the first ends straddle the plate 64. The other ends of the links 72, 74 are journally connected about a pin 78 at one end of a lever 80, these ends of the links 72, 74 respectively being at opposite surfaces of the lever, i.e., straddling the lever. Similarly, one end of a pair of links 2, 84 are journalled about a pin 86 adjacent the end 68 of the plate 64 at opposite faces thereof. The links 82, 84 are also joined at the central points 88 in the same fashion as the link 72 and 74. The other end of the links 82, 84 are connected to the lever 80 by means of a journal pin 90, the links 82, 84 being disposed respectively at opposite surfaces of the lever 80. Although only a single link such as 72 and 82 is kinematically necessary, by providing twin links and joining links 72 and 74 together and links 82 and 84 together as aforesaid assists in providing increased compression strength to the links. The location of the pin 90 relative to the length of the lever 80 is such that the pin 90 is spaced from an end 92 remote from the end where the pin 78 is located. This end 92 of the lever 80 is journally connected by means of a pin 94 to a pair of shoes 96, 98 which are secured respectively to the front and rear faces of the needle bar 30. The needle bar 30 preferably has a cut-out 100 at its top portion to enable the bottom end of the lever 80 to sit in position as shown due to space restrictions within existing tufting machine geometry.

As illustrated, the links 72, 74 are substantially shorter than the links 82, 84. Additionally, the mounting of these links to the lever 80 and the plate 64 effectively provides a quadric or four bar linkage, and suitable selection of the lengths of the links 72, 74 and 82, 84 together with the geometry of the plate 64, e.g., the distance between the pins 70 and 86, and the length and positions of the pins 78, 90, and 94 on the lever 80 produces near perfect vertical straight line motion at the pin 94 as the needle bar reciprocates vertically.

In order to provide a preload in the bearings which support the pins 70, 78, 86, 90 and 94, so as to prevent "chatter" the plate 64 and the lever 80 may be provided with a respective hub 102, 104 eccentrically journalled on a respective boss 106, 108, and having a set screw 107 or the like to secure the hubs in selective position on the boss. The hubs each have a bore 109 through which a rod or link 110 extends, the ends of the rod having adjusting members 112, 114 for initially tensioning the rod and for securing the rod with in the respective bar. Thereafter, the hubs may be rotated relative to the respective boss to change the eccentricity and preload the bearings, the rod bending slightly as illustrated. Thus, the rod or link 110 together with the hubs 102, 104, the bosses 106, 108 and the adjusting members 112, 114 provide a tensioning means for applying an adjustable force selectively to the lever 80 and the plate 64 tending to separate them. These elements, of course, are force applying means.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a laterally elongated vertically reciprocating needle bar carrying a plurality of needles, and a needle bar shifter including a drive rod for moving said needle bar laterally in accordance with a pattern, apparatus for coupling said drive rod to said needle bar to drive said needle bar laterally while permitting said needle bar to reciprocate, said apparatus comprising a driven member, means for fastening said driven member to said drive rod for lateral movement therewith, first and second links pivotably connected at respective first ends to said driven member, said second link being substantially longer than the first link, a lever having first and second ends, means for pivotably connecting said first end of said lever to said needle bar, means for pivotably connecting a second end of said first link to said lever adjacent said second end of said lever, and means for pivotably connecting a second end of said second link to said lever at a location spaced from the first and second end of said lever.

2. In a tufting machine having a laterally elongated vertically reciprocating needle bar carrying a plurality of needles, and a needle bar shifter including a drive rod for moving said needle bar laterally in accordance with a pattern, apparatus for coupling said drive rod to said needle bar to drive said needle bar laterally while permitting said needle bar to reciprocate, said apparatus comprising a driven member, means for fastening said driven member to said drive rod for lateral movement therewith, a first link having first and second ends, means for pivotably connecting the first end of said link to said driven member at a first location spaced above the needle bar, a second link having first and second ends, means for pivotably connecting the first end of said second link to said driven member at a second location spaced above the needle bar, said first location being further from said needle bar than said second location, said second link being substantially longer than said first link, a lever having first and second ends, means for pivotably connecting the first end of said lever to said needle bar, means for pivotably connecting the second end of said first link to said lever adjacent the second end of said lever, and means for pivotably connecting the second end of said second link to said lever intermediate the first end of said lever and the second end of said first link.

3. In a tufting machine as recited in claim 2, including means for applying an adjustable selective force to said lever and said driven member tending to separate said lever and said driven member.

4. In a tufting machine as recited in claim 2, wherein said driven member comprises a substantially planar plate, and said means for fastening said driven member to said drive rod comprises a rod having a planar face, and means for securing said plate to said planar face.

5. In a tufting machine as recited in claim 4, including tensioning means for applying an adjustably selective force to said lever and said plate tending to separate said lever and said plate.

6. In a tufting machine having a vertically fixed member and a vertically movable member, a pair of links pivotably connected at respective first ends to said fixed member and connected at respective second ends to said movable member, force applying means for applying a loading force to said fixed member and to said movable member tending to separate said members, said force applying means comprising a first hub journalled eccentrically on said fixed member, a second hub journalled eccentrically on said movable member, each of said hubs having a bore, a rod extending from said fixed member to said movable member and disposed in each bore, and means for securing the hubs in selected positions corresponding to selective eccentricities of said hubs to tension said rod and force said members apart.

* * * * *